US005321669A

United States Patent [19]

Thayer et al.

[11] Patent Number: 5,321,669

[45] Date of Patent: Jun. 14, 1994

[54] AROMATIC ALARM CLOCK SYSTEM

[76] Inventors: Richard Thayer, 1967 Bridge St.; George Konewal, 2163 Haworth St.; Edgar J. Tooley, 5237 Duffield St., all of Philadelphia, Pa. 19124

[21] Appl. No.: 115,580

[22] Filed: Sep. 3, 1993

[51] Int. Cl.[5] ..... G04B 47/00; B67D 3/00; G08B 1/00

[52] U.S. Cl. ..... 368/12; 368/250; 222/638; 222/644; 340/407.1

[58] Field of Search ..... 368/10, 12, 72-74, 368/246, 250, 251; 222/70, 645-648; 340/407, 628

[56] References Cited

U.S. PATENT DOCUMENTS

| | | | |
|---|---|---|---|
| 4,045,553 | 2/1987 | Kavoussi et al. | 368/12 |
| 4,407,585 | 10/1983 | Hartford et al. | 368/12 |
| 4,573,804 | 3/1986 | Kavoussi et al. | 368/12 |
| 5,046,648 | 9/1991 | Herbstzuber | 222/638 |
| 5,055,822 | 1/1991 | Campbell et al. | 340/407 |
| 5,212,672 | 5/1993 | Loisch et al. | 368/79 |

*Primary Examiner*—Vit W. Miska

[57] ABSTRACT

An aromatic alarm system for awakening a user to a pleasant smell at a pre-selected time comprising, in combination an electronic processor couplable to a source of power adapted to provide electric power and controls to the system; an optical display operatively coupled to the processor to display a time of day and a starting time, the optical display having associated operator variable controls to change the time of day and starting time; and an atomizer, a housing supporting the atomizer, the housing also supporting the processor, the atomizer including a reservoir of fluid to be atomized, an outlet orifice for dispensing atomized fluid, tubing coupling the outlet orifice and reservoir, a pump coupled to the tubing to convey fluid from the reservoir to the outlet orifice and convert it from the liquid state into the atomized state, a motor with an operator controlled variable resistor to operate the pump at a pre-selected intensity, an operator controlled on/off switch to energize the motor to allow activation of the motor and pump as a function of the starting time of the optical display as selected by the operator.

4 Claims, 4 Drawing Sheets

AROMATIC ALARM CLOCK SYSTEM

BACKGROUND OF THE INVENTION

1. Field of the Invention

The present invention relates to aromatic alarm clock systems and more particularly pertains to an operator control system with a generally conventional clock, radio and buzzer with the addition of an aromatic dispenser operable as a function of the radio and buzzer.

2. Description of the Prior Art

The use of aromatic systems is known in the prior art. More specifically, aromatic systems heretofore devised and utilized for the purpose of dispensing an aromatic mist are known to consist basically of familiar, expected and obvious structural configurations, notwithstanding the myriad of designs encompassed by the crowded prior art which have been developed for the fulfillment of countless objectives and requirements.

For example, dispensers for mist or fragrances are disclosed in a wide variety of devices. Consider for example units motor driven independent of time control are disclosed in U.S. Pat. No. 5,114,625 to Gibson. Dispensing through aerosol bottles are disclosed in U.S. Pat. No. 4,889,284 and 4,421,254, also to Spector. Fixed unpowered systems are disclosed in U.S. Pat. No. 4,722,264 to DeGuisseppe. Lastly, U.S. Pat. No. 4,500,480 to Cambio discloses a humidifier powered by a cartridge.

In this respect, the humidifier and system according to the present invention substantially departs from the conventional concepts and designs of the prior art, and in so doing provides an apparatus primarily developed for the purpose of timed release of the dispensed vapor in association with a computer controlled alarm clock buzzer for initiating dispensing concurrent with the vaporizing.

Therefore, it can be appreciated that there exists a continuing need for new and improved aroma dispensers which can be operated in a time controlled fashion at the selection of an operator. In this regard, the present invention substantially fulfills this need.

SUMMARY OF THE INVENTION

In view of the foregoing disadvantages inherent in the known types of aromatic dispensers now present in the prior art, the present invention provides an improved aromatic alarm clock system. As such, the general purpose of the present invention which will be described subsequently in greater detail, is to provide a new and improved aromatic alarm clock system apparatus and method which has all the advantages of the prior art atomizers and none of the disadvantages.

To attain this, the present invention essentially comprises an aromatic alarm clock system for awakening a user to a pleasant smell at a pre-selected time comprising, in combination an electronic processor couplable to a source of a power adapted to provide electric power and controls to the system; a radio assembly operatively coupled to the processor and having an operator controlled volume selector and station selector; a buzzer assembly operatively coupled to the processor and having an operator controlled on/off switch; an optical display operatively coupled to the processor to display a time of day and starting time for the radio and buzzer assemblies, the optical display having associated operator variable controls to change the time of day and starting time of the digital display, the optical display adapted to energize the radio and buzzer assemblies; and an atomizer, a housing supporting the atomizer, the housing also supporting the processor, radio and buzzer assemblies and optical display, the atomizer further including a reservoir of fluid to be atomized, a variably positionable outlet orifice for dispensing atomized fluid, tubing coupling the outlet orifice and reservoir, a pump coupled to the tubing to convey fluid from the reservoir to the outlet orifice and convert it from the liquid into the vapor state, a motor with an operator controlled variable resistor to operate the pump at a pre-selected intensity, an operator controlled on/off switch to energize the motor to allow coupling of the electronic processor to the motor to activate the atomizer, radio and buzzer as a function of the starting time of the optical display as selected by an operator.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended t define the invention of the application, which is measured by the claims, nor is it intended to be limiting as to the scope of the invention in any way.

It is therefore an object of the present invention to provide a new and improved aromatic alarm clock system which has all the advantages of the prior art atomizers and none of the disadvantages.

It is another object of the present invention to provide a new and improved aromatic alarm clock system which may be easily and efficiently manufactured and marketed.

It is a further object of the present invention to provide a new and improved aromatic alarm clock system which is of a durable and reliable construction.

An even further object of the present invention is to provide a new and improved aromatic alarm clock system which is susceptible of a low cost of manufacture with regard to both materials and labor, and which accordingly is then susceptible of low prices of sale to the consuming public, thereby making such aromatic alarm clock systems economically available to the buying public.

Still yet another object of the present invention is to provide a new aromatic alarm clock system which provides in the apparatuses and methods of the prior art some of the advantages thereof, while simultaneously overcoming some of the disadvantages normally associated therewith.

Still another object of the present invention is to awaken users at a pre-selected time through the use of an aromatic mist.

Yet another object of the present invention is to initiate, concurrently with an alarm clock and/or buzzer, a pleasant aroma of a type pre-selected by the user.

Even still another object of the present invention is to atomize a pre-selected aroma into the room of a user at a time determined by an operator either at the present or at a future time as programmed into a computer.

Lastly, it is an object of the present invention to provide an aromatic alarm system for awakening a user to a pleasant smell at a pre-selected time comprising, in combination an electronic processor couplable to a source of power adapted to provide electric power and controls to the system; an optical display operatively coupled to the processor to display a time of day and a starting time, the optical display having associated operator variable controls to change the time of day and starting time; and an atomizer, a housing supporting the atomizer, the housing also supporting the processor, the atomizer including a reservoir of fluid to be atomized, an outlet orifice for dispensing atomized fluid, tubing coupling the outlet orifice and reservoir, a pump coupled to the tubing to convey fluid from the reservoir to the outlet orifice and convert it from the liquid state into the atomized state, a motor with an operator controlled variable resistor to operate the pump at a pre-selected intensity, an operator controlled on/off switch to energize the motor to allow activation of the motor and pump as a function of the starting time of the optical display as selected by the operator.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matte in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
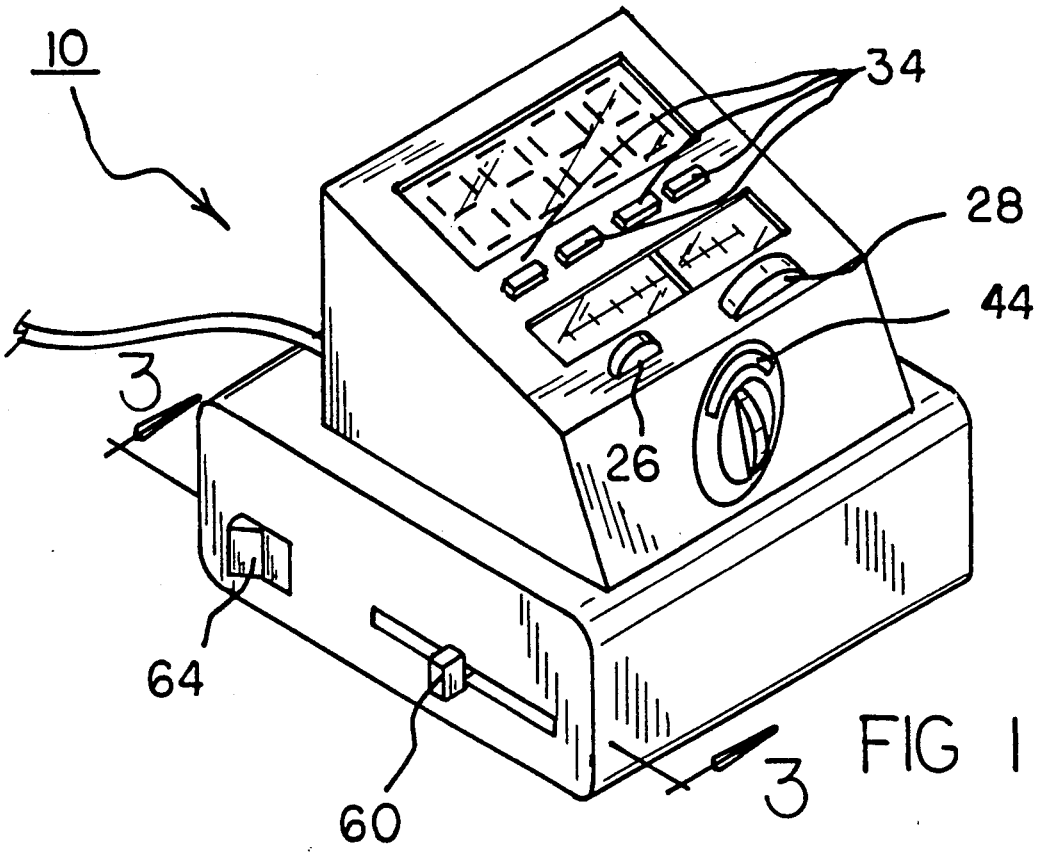
FIG. 1 is perspective of the aromatic alarm clock system constructed in accordance with the principles of the present invention.
Figure 2:
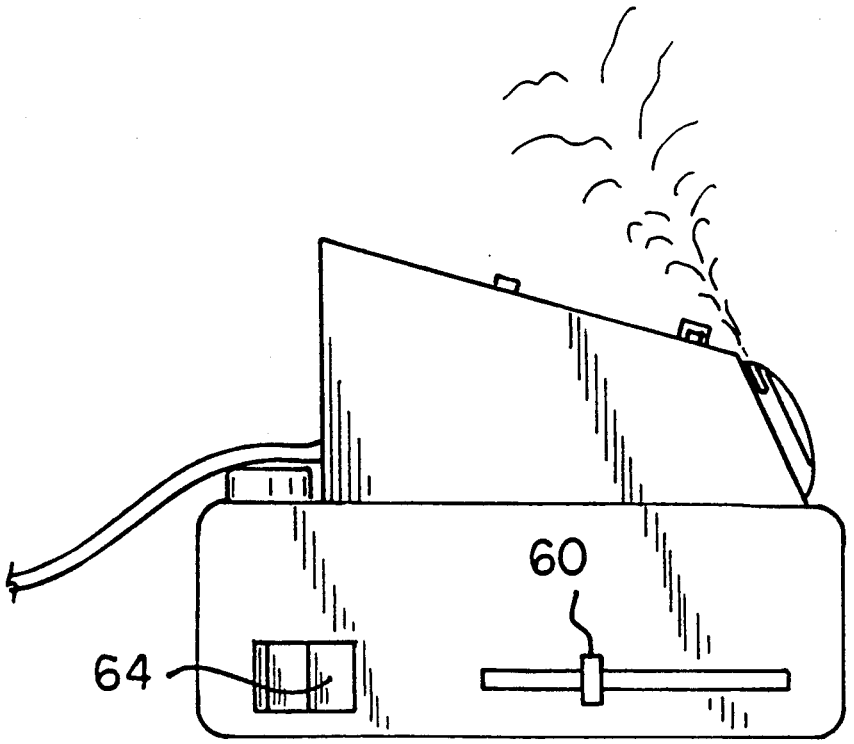
FIG. 2 is side elevational view of the system of FIG. 1.
Figure 3:
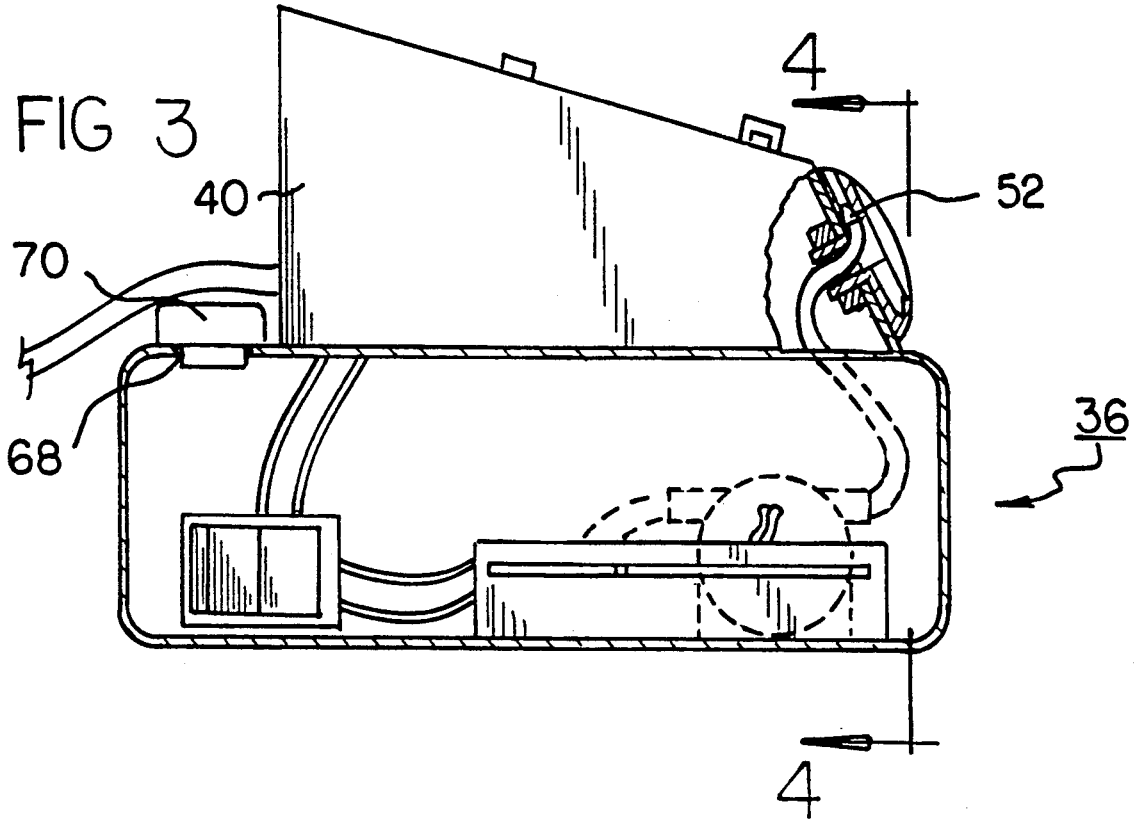
FIG. 3 is a sectional view taken along line 3—3 of FIG. 1.
Figure 4:
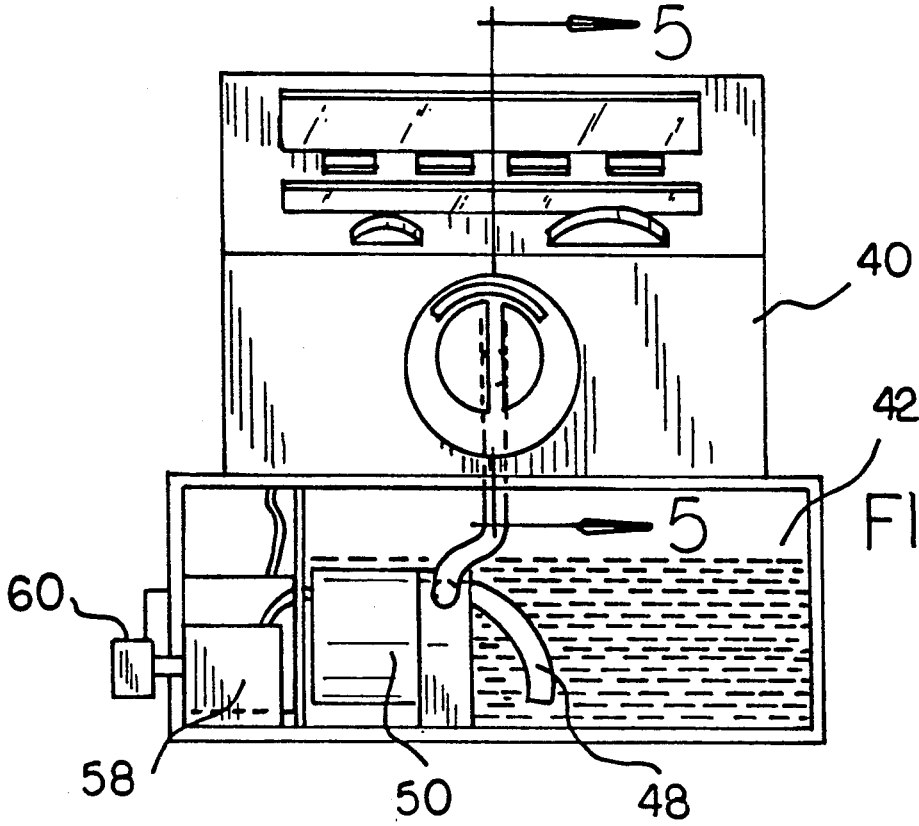
FIG. 4 is a sectional view taken along line 4—4 of FIG. 3.
Figure 5:
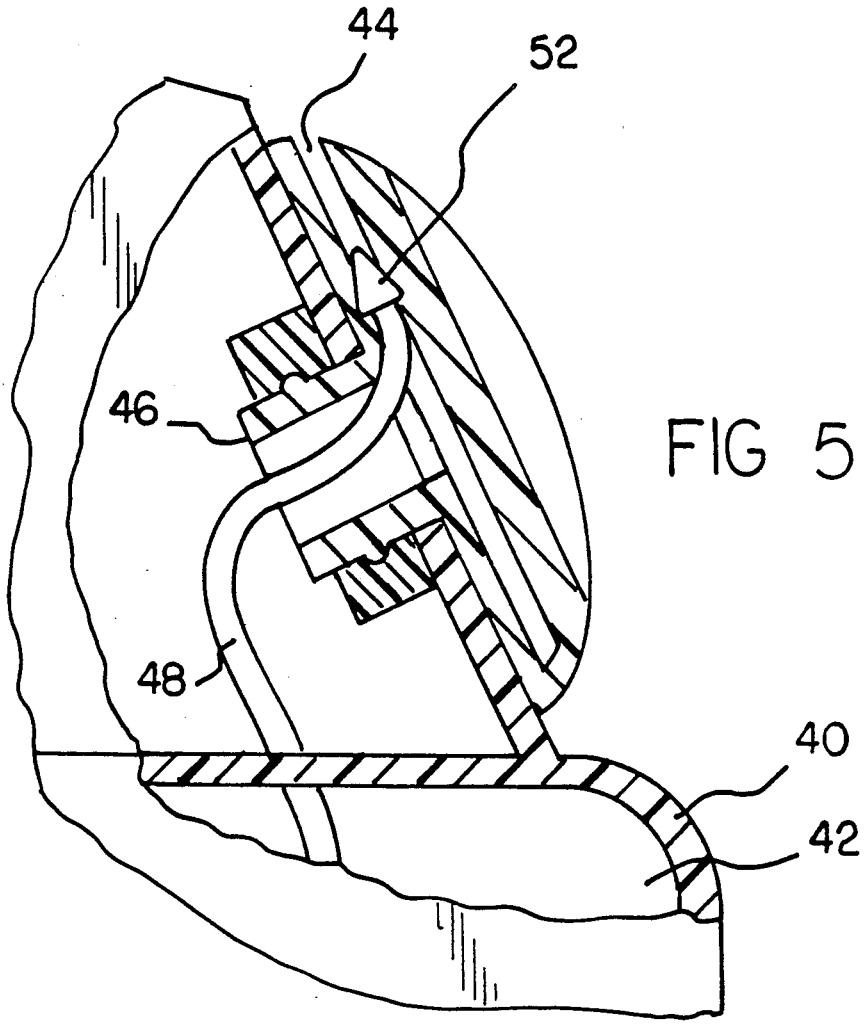
FIG. 5 is a sectional view taken along line 5—5 of FIG. 4.
Figure 6:
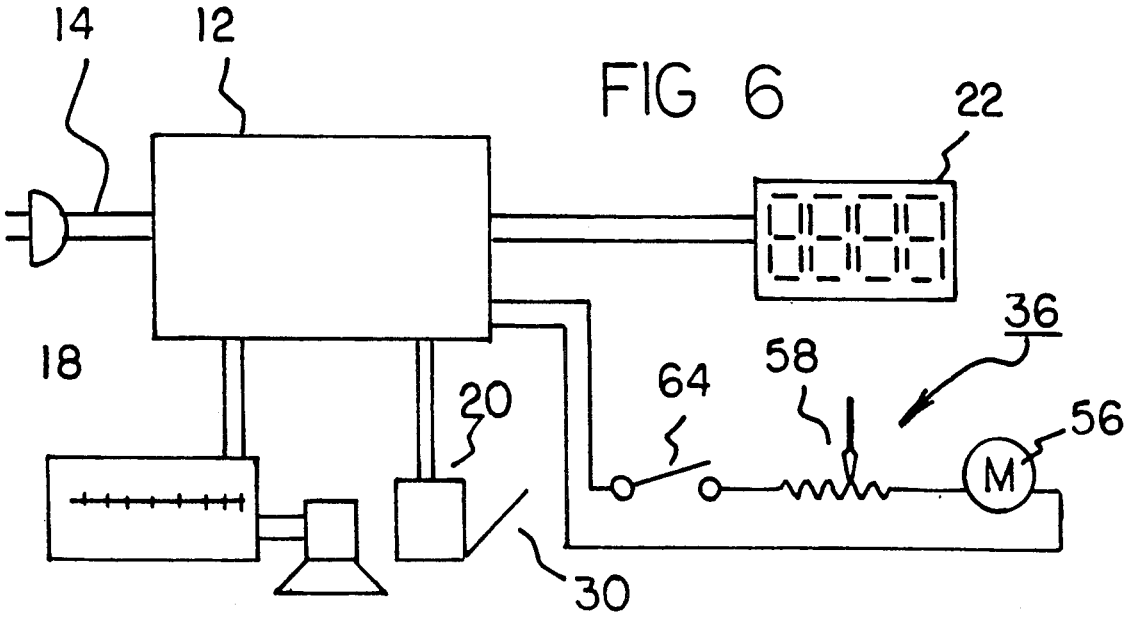
FIG. 6 is a electrical schematic of the control system of the apparatus of the prior Figures.

With reference now to the drawings, and in particular to FIG. 1 thereof, a new and improved aromatic alarm clock system embodying the principles and concepts of the present invention and generally designated by the reference numeral 10 will be described.

More specifically, it will be noted that the aromatic alarm clock system 10 is designed for awakening a user to a pleasant smell at a pre-selected time of the user's choice. The central component of the system is an electronic processor 12. As is normal, the electronic processor is couplable by lines 14 to a source of potential adapted to provide electrical power and controls to the system. In a generally conventional fashion, the system includes a radio assembly 18, a buzzer assembly 20, and an optical display 22.

The radio assembly 18 is operatively coupled to the processor. It has an operator controlled volume selector 26 and a station selector 28 in the conventional manner. It is also provided with a switch for selection between AM and FM stations.

The second generally conventional component of the system is a buzzer assembly 20. The buzzer assembly, like the radio assembly is operatively coupled to the processor. It has an operator controlled off/on switch 30 to turn off the buzzer independent of the radio in the normal fashion.

The optical display 22 is likewise coupled to the electronic processor 12. The optical display functions to display the time of day. It also functions to provide a starting time for the radio and buzzer assemblies. Associated with the optical display are operator variable controls, buttons 34 to change and correct the time of day as displayed. The optical display is also of capable through the variable operator controls 34 to change the starting time of the radio, buzzer and aromatic dispenser. The change in the starting time will in turn vary the optical display and determine the time at which the radio and buzzer assemblies are energized to awaken a user. For all practical purposes, the buzzer assembly, radio assembly, and optical display function conventionally with an electronic processor as many radio alarm clocks which are commercially available from a wide variety of sources.

In addition to the other functions of the system, there is also provided an atomizer 36. The atomizer as well as the other components of the system are all packaged within a housing 40. The housing also supports the reservoir 42 of the atomizer for the fluid to be atomized. The exterior surface of the housing is provided with an outlet of the orifice 44 for dispensing the atomized fluid. The orifice is variably positionable with a swivel 46 for motorized movement about its axis within the housing.

Tubing couples 48 the outlet orifice 44 and the reservoir 42. A pump 50 coupled within an intermediate extent of the tubing functions to convey the fluid from the reservoir to the outlet orifice. The pump, in association with a nozzle at the outlet orifice end of the tubing, functions to convert the liquid in the reservoir to the vapor state by movement through a nozzle 52 for constituting the aromatic dispensed material.

A motor 56 under the control of an operator functions through a resistor 58 and lever 60 to operate the pump at a predetermined intensity. An operator controlled off/on switch 64 energizes the motor whereby the motor and atomizer may be activated by an operator by throwing the off/on switch and awaiting for the electronic processor to initiate the motor to activate the atomizer along with the radio and buzzer as a function of the starting time of the optical display as may be selected by the user. The on/off switch 64 under the control of the operator opens and closes the circuit to energize or deenergize the circuit whereby the processor may function to activate or inactivate the atomizer, radio and buzzer as a function of the selected start time.

Located at an intermediate horizontal extent of the housing immediately above the reservoir is an aperture 68 and a cap 70. The aperture is positioned whereby a user may dispense liquid into the reservoir for being atomized. The cap is adapted to cover the atomizer to preclude evaporation to ambient atmosphere. In association with the fluid, as for example water, additional materials may be utilized with the fluid by being dropped through the aperture. Such additional materials might be dried compressed aromatic tablets 74 either of a fragrance as of a flower or perfume or it may be of a pleasant morning aroma such as bacon, coffee or the like.

Figure 7:
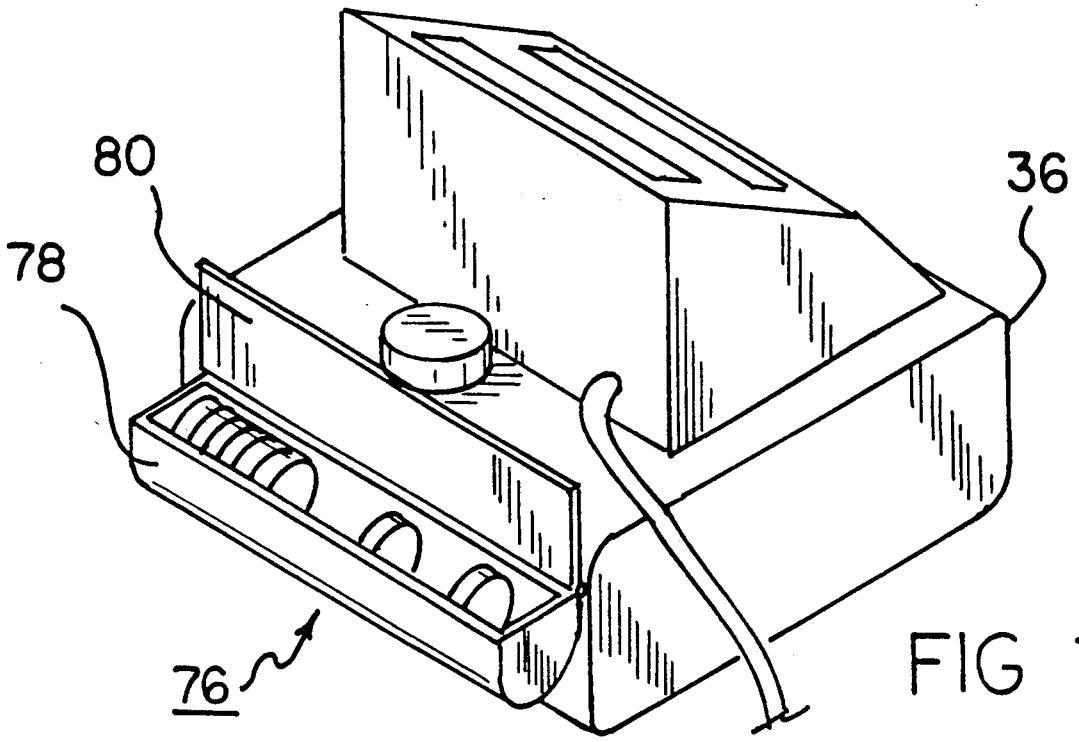
FIG. 7 is a perspective view of an alternate embodiment of the present invention.

The FIG. 7 illustration is an alternate embodiment of the present invention. Its operating components are essentially the same as that described with the embodiment of FIGS. 1–6. In addition, however, a holder 76 is provided on the rear face of the housing. The holder has a semi-cylindrical lower portion 78 and a pivotal cover 80. The opening within the holder is of such size and shape as to support a plurality of tablets 74 of dried compressed materials to facilitate an intended aroma for a particular function. The holder may support a plurality of the same tablets or tablets of a variety of aromas as so specified and marked.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An aromatic alarm system for awaking a user to a pleasant smell at a pre-selected time comprising, in combination:

an electronic processor couplable to a source of power adapted to provide electric power and controls to the system;

an optical display operatively coupled to the processor to display a time of day and a starting time, the optical display having associated operator variable controls to change the time of day and starting time; and an atomizer, a housing supporting the atomizer, the housing also supporting the processor, the atomizer including a reservoir of fluid to be atomized, a first outlet orifice for dispensing atomized fluid, tubing coupling said first outlet orifice and reservoir, a pump coupled to the tubing to convey fluid from said first outlet orifice and convert it from the liquid state into the atomized state, a motor with an operator controlled variable resistor to operate the pump at a pre-selected intensity, an operator controlled on/off switch to energize the motor to allow activation of the motor and pump as a function of the starting time of the optical display as selected by the operator, wherein said first outlet orifice is variably positionable by an operator, said first outlet orifice being mounted in a rotatable swivel mounted on said housing, said swivel having a second outlet orifice communicating with said first outlet orifice to direct said atomized liquid aroma at a pre-selected angle relative to said housing.

2. The system as set forth in claim 1 and further including a radio assembly and a buzzer assembly within the housing operable through the electronic processor as a function of a set time.

3. The system as set forth in claim 1 and further including an aperture in the housing with a cap located over the reservoir for the adding of fluid to the reservoir.

4. The system as set forth in claim 1 and further including a container formed as part of the housing for receiving dried compressed aromatic tablets capable of being dropped through the aperture into the reservoir.

* * * * *